US006597097B2

(12) United States Patent
Jeong

(10) Patent No.: US 6,597,097 B2
(45) Date of Patent: Jul. 22, 2003

(54) CATHODE RAY TUBE HAVING PANEL WITH IMPROVED TENSILE STRESS

(75) Inventor: Seong-Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 93 days.

(21) Appl. No.: 09/929,096

(22) Filed: Aug. 15, 2001

(65) Prior Publication Data

US 2002/0057049 A1 May 16, 2002

(30) Foreign Application Priority Data

Sep. 26, 2000 (KR) ..... 2000-56539
Feb. 27, 2001 (KR) ..... 2001-10139

(51) Int. Cl.[7] ..... H01J 29/10; H01J 31/00; H01J 61/30; H01K 1/28; H01K 3/22

(52) U.S. Cl. ..... 313/461; 313/476; 313/477 R; 220/2.1 A; 220/2.1 R

(58) Field of Search ..... 313/461, 476, 313/477 R; 220/2.1 A, 2.1 R; 348/821; 445/24, 25

(56) References Cited

U.S. PATENT DOCUMENTS 5,925,977 A * 7/1999 Sugawara et al. ..... 313/477 R
RE36,838 E * 8/2000 Sugawara et al. ..... 313/477 R
6,232,712 B1 * 5/2001 Pyun et al. ..... 313/477 R
6,388,373 B1 * 5/2002 Nah ..... 313/474

* cited by examiner

*Primary Examiner*—Nimeshkumar D. Patel
*Assistant Examiner*—Matt Hodges
(74) *Attorney, Agent, or Firm*—Birch, Stewart, Kolasch & Birch, LLP

(57) ABSTRACT

There is provided a cathode-ray tube including an envelope having a neck, a funnel and a panel fused to the funnel by using frit glass, the outside of the panel being near flat, the inside of the panel having a predetermined curvature, in which $1.7 \leqq T2/T1 \leqq 2.3$ when T1 is the thickness of the center of the panel and T2 is the thickness of the diagonal corner of the panel, and a panel inside tensile stress at the fused portion of the panel and funnel is less than $-1.3876x+128.24$ (Kgf/cm$^2$) when the size of the effective picture area of the cathode-ray tube is x(unit: cm). The panel inside tensile stress at the fused portion of the panel and funnel is maintained below a predetermined value to mitigate breakage inside the furnaces that occurs when the cathode-ray tube having the panel whose outside is near flat and whose inside has a predetermined curvature is reproduced, thereby improving the salvage rate.

14 Claims, 7 Drawing Sheets

P_out :panel outside stress
P_cent :panel center stress
P_in :panel inside stress
F_out :funnel outside stress
F_out :funnel center stress
F_out :funnel inside stress

CATHODE RAY TUBE HAVING PANEL WITH IMPROVED TENSILE STRESS

BACKGROUND OF THE INVENTION

1. Field of the Invention

The present invention relates to a cathode-ray tube having a panel whose outside is flat and, more particularly, to a flat cathode-ray tube in which stress distribution at a fused portion of the panel and funnel is artificially changed to improve salvage rate of glass in a salvage process.

2. Description of the Related Art

As shown in FIG. 1, a cathode-ray tube generally includes a panel 1 set at the front thereof, a shadow mask 3 for selecting colors of electron beams emitted to the inside of the panel 1, a frame 4 for fixing and supporting the shadow mask 3, a stud pin 6 for fixing the frame 4 to the panel 1, a funnel 2 combined with the panel 1 with each other to maintain the inside of the cathode-ray tube in vacuum state, a spring 5 connecting the stud pin 6 and the frame, a tube-shaped neck 10 located at the back of the funnel 2, an electron gun 8 set inside the neck 10 to emit electron beams 11, an inner shield 7 combined with the frame 4 to shield external magnetic field such as terrestrial magnetic field acting on the emitted electron beams 11, a deflection yoke 9 fixing the exterior of the funnel 2 to defect electron beams 11, and an explosion-proof band 12 placed at the skirt of the panel 1.

As shown in FIG. 2A, both of the inside and outside of the general panel 1 have a specific curvature. Thus, images displayed are distorted because of the curvature of the outside so that people feel uncomfortable to watch them. Furthermore, severe reflection of external rays of light due to the curvature aggravates eyestrain. A cathode-ray tube proposed for solving this problem employs a panel structure whose outside is perfectly flat, as shown in FIG. 2B, to allow people to feel comfortable to see images display thereon. This structure (referred to as FCD hereinafter) is widely being used since it can realize flat images, being capable of removing distortion of images in an appropriate visual range and mitigating eyestrain in the consideration of the image floatation effects.

The cathode-ray tube is fabricated by passing through multiple processes including a process of forming a screen on the inside of the panel, a sealing process of fusing the panel 1 and the funnel 2 to each other using frit glass to seal them, and an exhaust process for making the inside of the cathode-ray tube with high vacuum. In addition, constituent elements such as the electron gun 8, shadow mask 3, frame 4 and inner shield 7 are set inside the cathode-ray tube. There may be generated a fail in a specific element during the fabrication process or after completion of the process or generated a fail in a specific process. In this case, it is required that a poor cathode-ray tube is salvaged.

FIG. 3 is a diagram for explaining a salvage mechanism of the cathode-ray tube. The neck of the cathode-ray tube is cut to cancel the vacuum state inside the cathode-ray tube, the band is removed, and to be mounted on a starting zone. Then, the frit is partially eliminated using nitric acid at an etching zone, and the nitric acid on the panel and funnel is removed by water at a cleaning zone. Here, lots of origins are generated in the frit. Furthermore, different stresses are created at the inside and outside of the panel, funnel and frit while passing through a first hot water zone and a cool water zone. Especially, the glass component is broken by tensile stress at the origins. The frit is detached up to a portion of the inside thereof where compressive stress exists because the tensile stress is applied to the outside thereof while passing through the first hot water zone and the cool water zone. Then, the tensile stress is applied to the inside of the frit and the compressive stress is applied to the outside thereof while passing through the cool water zone and a second hot water zone, thereby completely detaching the frit.

The conventional cathode-ray tube panel has the inner and outer surfaces having specific curvatures, as shown in FIG. 2A, to secure structural strength. Thus, its corner can have a thickness of less than 130% of that of its center. In this case, there is no problem in salvaging the cathode-ray tube. In case of the panel (FCD) whose outside is flat and whose inside has a specific curvature, as shown in FIG. 2B, however, its corner has a thickness of more than 170% of that of its center because its inner side has a curvature similar to that of the mask and its outside is flat in order to maximize the structural strength of the shadow mask. This increases the thickness of the panel to maintain the strength of the mask, but the panel structure is vulnerable to thermal stress. Especially, the distribution of the stress of the panel is not uniform. Moreover, the cathode-ray tube must go through furnaces to be fabricated when it passes through Stabi process for removing welding stress in combination of the shadow mask and the frame, the frit sealing process for fusing the panel and the funnel to each other, and the exhaust process for easily emitting electron beams. This makes stress structure of the frit glass more non-uniform. Plenty of breakage occurs in the salvage process for separating the panel and the funnel from each other due to the non-uniform stress structure. Furthermore, the non-uniform stress structure deteriorates the strength of the panel.

In case that the wedge rate of the panel is above 170%, tensile stress of the fused portion due to thermal shock in the furnaces becomes very large, to bring about "corner pull" phenomenon that means breakage at the diagonal corners of the panel when the panel and funnel are detached from each other, as shown in FIG. 4. This decreases the salvage rate of the panel and funnel that conventionally accounts for 35–45% of the cost of the FCD-type tube. To minimize this breakage rate requires improvement in complicated furnace processes such as Stabi process, frit sealing process, exhaust process, etc. and, especially, management of the stress in the frit sealing process for fusing the panel and funnel to each other in fabrication of the cathode-ray tube. However, this needs exorbitant investment for improvement of temperature of the furnace and deteriorates productivity to increase the cost of products.

SUMMARY OF THE INVENTION

It is, therefore, an object of the present invention to provide a cathode-ray tube capable of being manufactured with high productivity without requiring an additional investment.

To accomplish the object of the present invention, there is provided a cathode-ray tube including an envelope having a neck, a funnel and a panel fused to the funnel by using frit glass, the outside of the panel being near flat, the inside of the panel having a predetermined curvature, in which $1.7 \leqq T2/T1 \leqq 2.3$ when T1 is the thickness of the center of the panel and T2 is the thickness of the diagonal corner of the panel, and a panel inside tensile stress at the fused portion of the panel and funnel is less than $-1.3876x+128.24$ ($Kgf/cm^2$) when the size of the effective picture area of the cathode-ray tube is x(unit: cm).

When the size of the effective picture area of the cathode-ray tube is x (unit: cm), the panel inside tensile stress at the fused portion of the panel and funnel is preferably less than −1.4625x+119.88 and more preferably less than −1.487x+117.1.

DETAILED DESCRIPTION OF THE PREFERRED EMBODIMENT

Reference will now be made in detail to the preferred embodiments of the present invention, examples of which are illustrated in the accompanying drawings.

Figure 1:
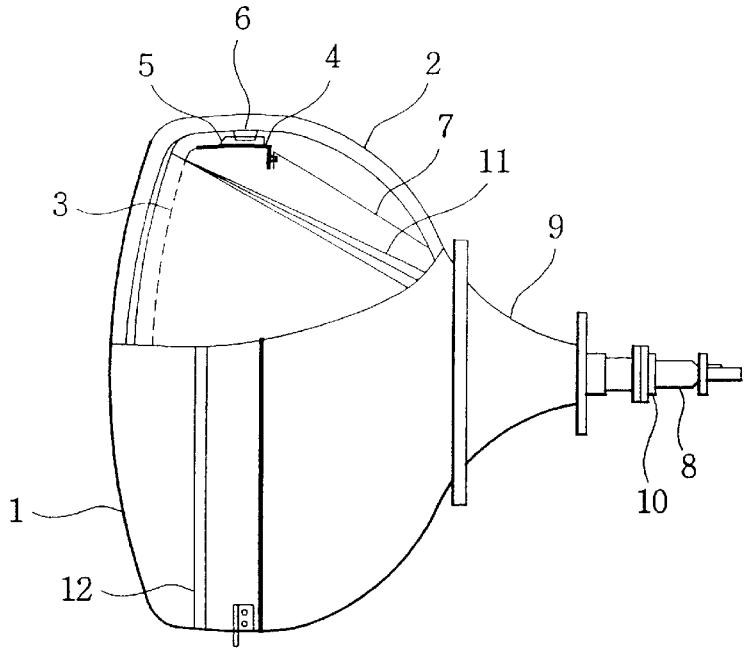
FIG. 1 Conventional Art
FIG. 1 illustrates the structure of a conventional cathode-ray tube.
Figure 2A:
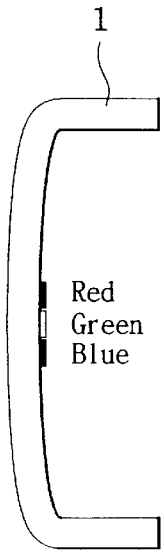
FIG. 2a Conventional Art
FIGS. 2*a* and 2*b* illustrate the panel structure of the conventional cathode-ray tube and the flat cathode-ray tube respectively.
Figure 2B:
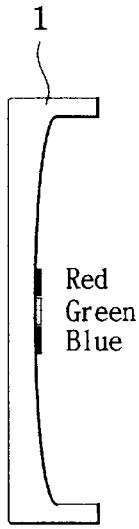
Figure 3:
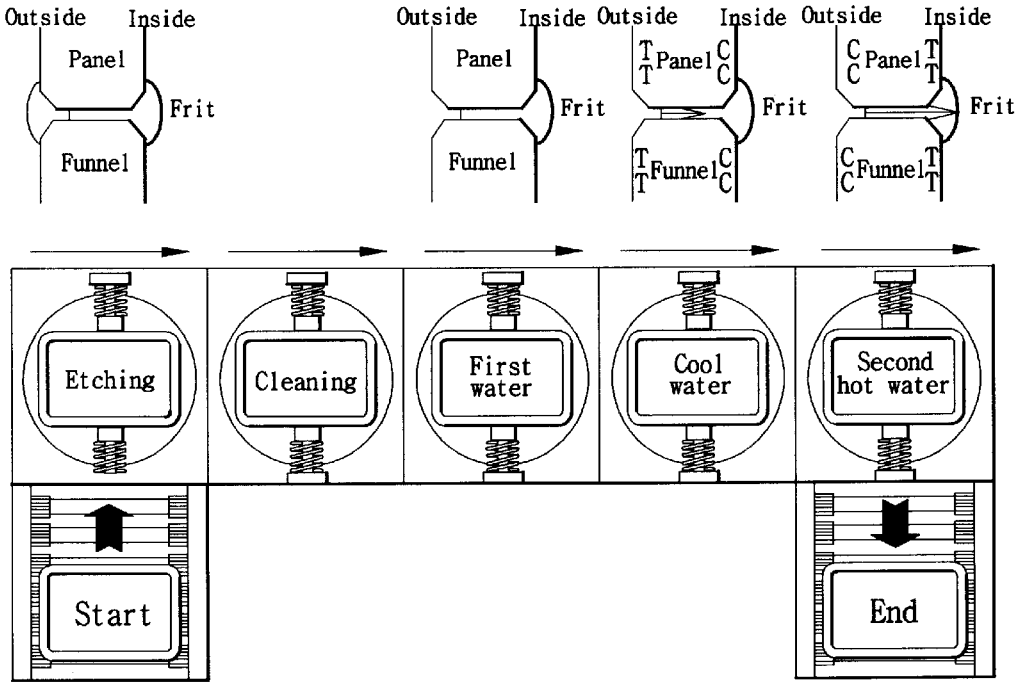
FIG. 3 illustrates a salvage mechanism of the cathode-ray tube.
Figure 4:
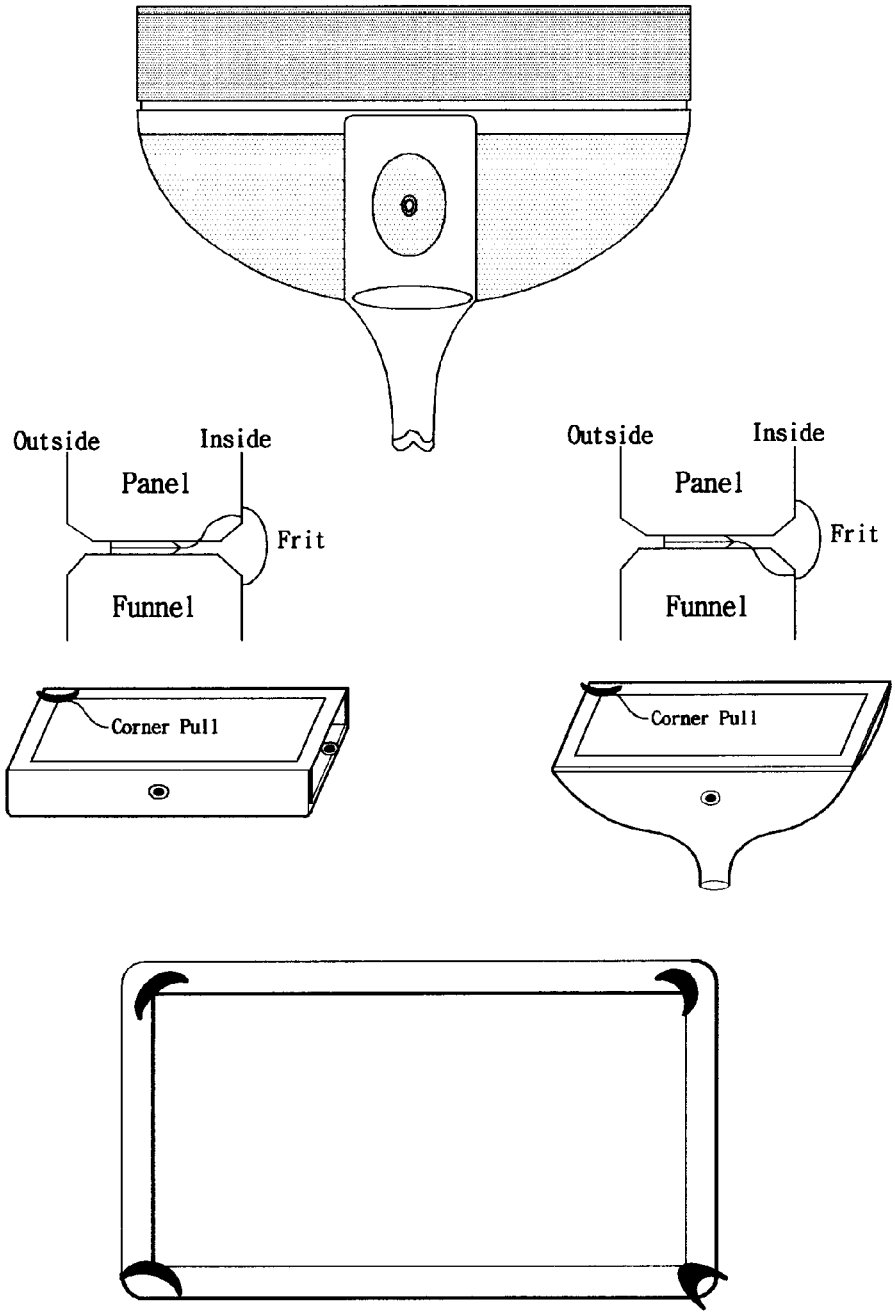
FIG. 4 illustrates corner pull phenomenon generated when the panel and funnel are detached from each other.
Figure 5:
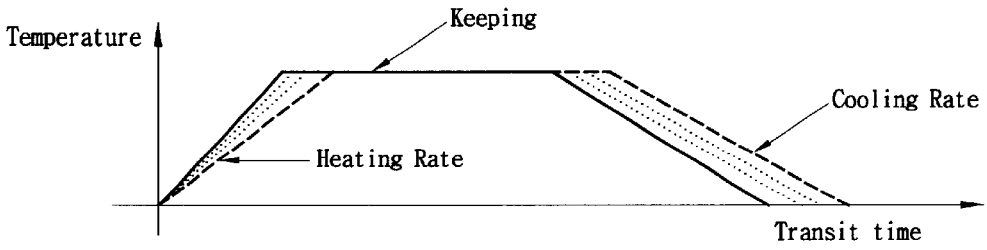
FIG. 5 is a graph illustrating a furnace schedule in a frit sealing process.

The inventor carried out a test for finding out key factors affecting salvage of cathode-ray tubes according to a variation in the temperature inside the frit sealing furnace on the basis of the fact that considerable irregular temperature distribution generates at the fused portion of the diagonal corner of the panel due to a thickness difference caused by wedge rate thereat. FIG. 5 is a graph illustrating a furnace schedule in the frit sealing process. The factors of heating rate, keeping time, cooling rate and peak temperature can be found from this graph. Tests were made in such a manner that products that have passed the frit-sealing furnace were salvaged, with different index times of the products passing through the sealing furnace by indices in FIG. 3. The result is shown in the following table 1. Here, the same salvage process is applied to all of the products, with conditions that spray-type etching is performed for 190 seconds at 58° C., the first hot water zone processing is carried out for 90 seconds at 58° C., the cool water zone processing is executed for 38 seconds at 28° C. and the second hot water zone processing is performed for 45 seconds at 54° C.

TABLE 1

Sealing temperature profile analysis

| | Test#1 | Test#2 | Test#3 | Test#4 |
|---|---|---|---|---|
| Heating rate(° C./min) | 14.1 | 10.9 | 11.1 | 10.8 |
| Keeping time(min) | 27.7 | 35.0 | 32.9 | 29.6 |
| Cooling rate(° C./min) | 6.1 | 6.0 | 5.7 | 5.8 |
| Peak temperature(° C.) | 454.8 | 451.0 | 445.3 | 443.0 |
| Salvage rate(%) | 5 | 100 | 75 | 90 |

Referring to Table 1, it can be known that the salvage rate is previously determined by the heating rate, keeping time, cooling rate and peak temperature in the sealing furnace.

Figure 6:
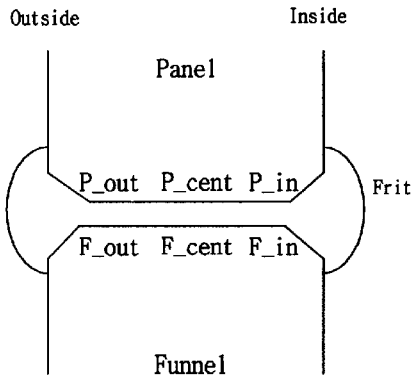
FIG. 6 is a diagram for explaining a relationship between salvage rate and stresses by positions of a fused portion of the panel and funnel.

FIG. 6 is a diagram for explaining a relationship between stresses by positions of the fused portion of the panel and funnel and the salvage rate. The stress at the fused portion of the panel and funnel by positions of the fused portion was divided into panel outside stress (P_out), panel center stress (P_center), panel inside tensile stress (P_in), funnel outside stress (F_out), funnel center stress (F_center) and funnel inside tensile stress (F_in), and a correlation between these stresses and the salvage rate was analyzed. The result is shown in the following table 2.

TABLE 2

Analysis of correlation by stresses

| Variable | P_out | P_cent | P_in | F_out | F_cent | F_in | Salvage rate |
|---|---|---|---|---|---|---|---|
| P_out | 1.000 | 0.5989 | 0.4194 | 0.0331 | −0.6696 | 0.1796 | 0.3779 |
| P_cent | 0.5989 | 1.0000 | 0.8917 | −0.7277 | 0.1486 | −0.1279 | 0.9304 |
| P_in | 0.4194 | 0.8917 | 1.0000 | −0.8861 | 0.3900 | −0.5630 | 0.9863 |
| F_out | 0.0331 | −0.7277 | −0.8861 | 1.0000 | −0.7642 | 0.6157 | −0.9119 |
| F_cent | −0.6696 | 0.1486 | 0.3900 | −0.7642 | 1.0000 | −0.5885 | 0.4328 |
| F_in | 0.1796 | −0.1279 | −0.5630 | 0.6157 | −0.5885 | 1.0000 | −0.4631 |
| Salvage rate | 0.3779 | 0.9304 | 0.9863 | −0.9119 | 0.4328 | −0.4631 | 1.0000 |

As shown in the Table 2, the correlation of the salvage rate and the stresses by positions of the fused portion of the panel and funnel has the highest value of 0.9863 of the panel inside tensile stress (P_in). Consequently, the panel inside tensile stress (P_in) has the greatest influence on the salvage rate.

Next, relationships between the panel inside tensile stress (P_in) at the fused portion of the panel and funnel and the heating rate, keeping time, cooling rate and peak temperature in the sealing furnace was analyzed by a statistical analysis method.

The result is shown in the following table 3.

TABLE 3

Analysis of key factors by stresses

| | Equation | R-square | F-ratio | Correlation |
|---|---|---|---|---|
| Heating rate (° C./min) | P_in = 155.1 − 16.2*heat | 0.9 | 0.04 | O |
| Keeping time (min) | P_in = 204.1 − 9.6*keep | 0.4 | 0.3 | x |
| Cooling rate (° C./min) | P_in = 401.1 − 74*cool | 0.3 | 0.5 | x |
| Peak temperature ((° C.) | P_in = 1237.5 − 4*peak | 0.4 | 0.4 | x |

Referring to Table 3, the heating rate having R-square of 0.9 and F-ratio of 0.04 has discriminative correlation from the other factors. In general, a factor having R-square of above 0.5 and F_ratio of below 0.05 is considered to have correlation according to the statistical analysis method. Consequently, since the heating rate among the factors in the sealing furnace has the highest correlation with the panel inside tensile stress (P_in) at the fused portion of the panel and funnel, the panel inside tensile stress (P_in) can be managed by managing the index time including the heating rate in the sealing furnace. For instance, the sealing furnace index time of 29" FCD cathode-ray tube is 18–19 seconds, approximately. It was confirmed that the panel inside tensile stress (P_in) at the fused portion of the panel and funnel becomes smaller as the index time becomes longer but becomes larger as it becomes shorter.

Figure 8:
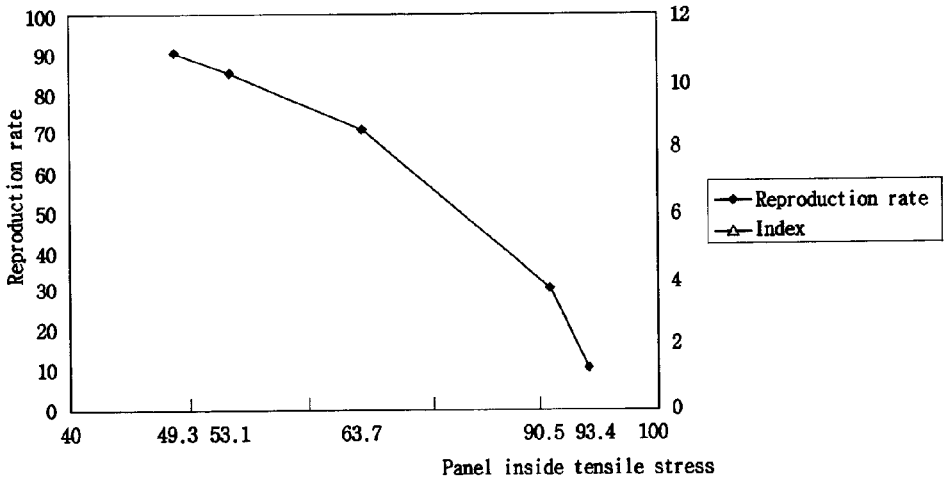
Figure 9:
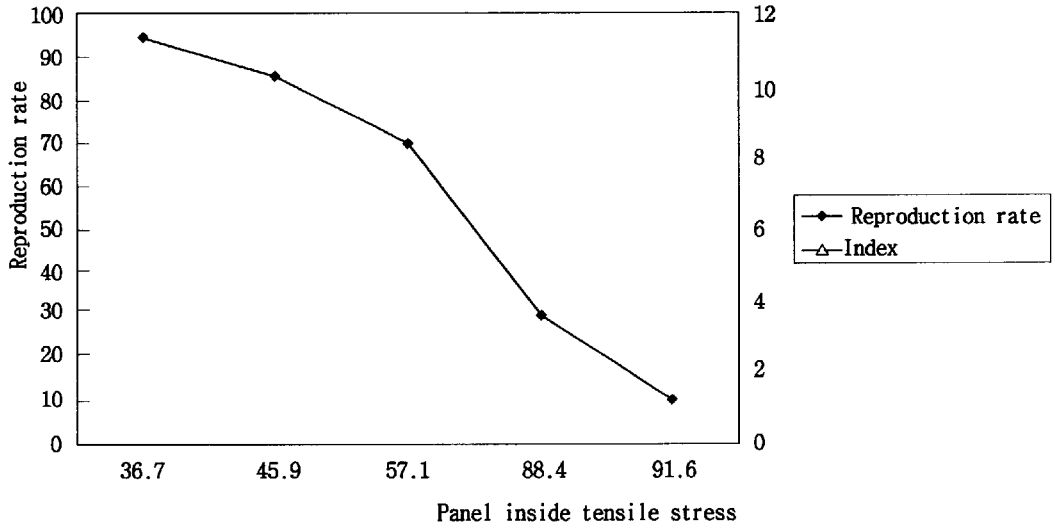

The inventor tested salvage rates by inside tensile stresses with respect to 17" (406 mm), 19" (457 mm), 21" (508 mm), 25" (590 mm) and 29" (676 mm) FCD cathode-ray tubes in order to confirm the relation between the panel inside tensile stress (P_in) and the salvage rate. The tested results are shown in Table 4 and FIG. 7, Table 5 and FIG. 8, Table 6 and FIG. 9, Table 7 and FIG. 10, and Table 8 and FIG. 11, respectively.

TABLE 4

Relationship between the panel inside tensile stress and salvage rate with respect to 17" FCD

| | | | | | |
|---|---|---|---|---|---|
| Panel inside tensile stress (Kgf/cm$^2$) | 56.9 | 60.4 | 72.0 | 92.9 | 95.0 |
| Salvage rate (%) | 90 | 85 | 70 | 30 | 10 |

TABLE 5

Relationship between the panel inside tensile stress and salvage rate with respect to 19" FCD

| | | | | | |
|---|---|---|---|---|---|
| Panel inside tensile stress (Kgf/cm$^2$) | 49.3 | 53.1 | 63.7 | 90.5 | 93.4 |
| Salvage rate (%) | 90 | 85 | 70 | 30 | 10 |

TABLE 6

Relationship between the panel inside tensile stress and salvage rate with respect to 21" FCD

| | | | | | |
|---|---|---|---|---|---|
| Panel inside tensile stress (Kgf/cm$^2$) | 36.7 | 45.9 | 57.1 | 88.4 | 91.6 |
| Salvage rate (%) | 90 | 85 | 70 | 30 | 10 |

TABLE 7

Relationship between the panel inside tensile stress and salvage rate with respect to 25" FCD

| | | | | | |
|---|---|---|---|---|---|
| Panel inside tensile stress (Kgf/cm$^2$) | 29.5 | 33.8 | 46.6 | 76.7 | 88.2 |
| Salvage rate (%) | 90 | 85 | 70 | 30 | 10 |

TABLE 8

Relationship between the panel inside tensile stress and salvage rate with respect to 29" FCD

| | | | | | |
|---|---|---|---|---|---|
| Panel inside tensile stress (Kgf/cm$^2$) | 13.9 | 27.1 | 32.5 | 68.3 | 82.6 |
| Salvage rate (%) | 90 | 85 | 70 | 30 | 10 |

Figure 7:
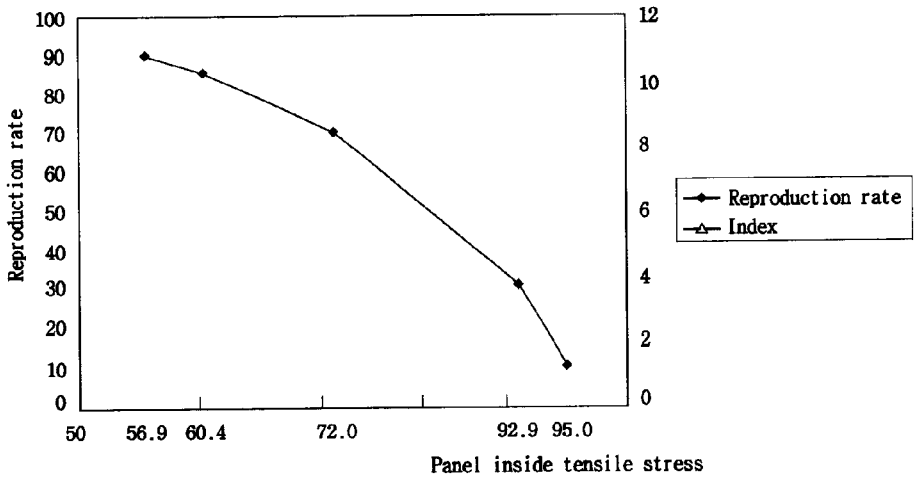
FIGS. 7 to 11 are graphs showing salvage rates based on the panel inside tensile stress (P_in) at the fused portion of the funnel and panel with respect to 17" FCD, 19" FCD, 21" FCD, 25" FCD and 29" FCD, respectively.

The salvage rate is 70% approximately when the panel inside tensile stress (P_in) of the fused portion of the panel and funnel is 72.0 (Kgf/cm$^2$) and it abruptly decreases when the tensile stress is above 72.0 (Kgf/cm$^2$) in case of 17" FCD (406 mm) as shown in Table 4 and FIG. 7. The salvage rate is 70% approximately when the panel inside tensile stress (P_in) is 63.7 (Kgf/cm$^2$) and it abruptly decreases when the tensile stress is larger than 63.7 (Kgf/cm$^2$) in case of 19" FCD (457 mm) as shown in Table 5 and FIG. 8. The salvage rate is 70% approximately when the panel inside tensile stress (P_in) 57.1 (Kgf/cm$^2$) and it abruptly decreases when the tensile stress is above 57.1 (Kgf/cm$^2$) in case of 21" FCD (508 mm) as shown in Table 6 and FIG. 9.

Figure 10:
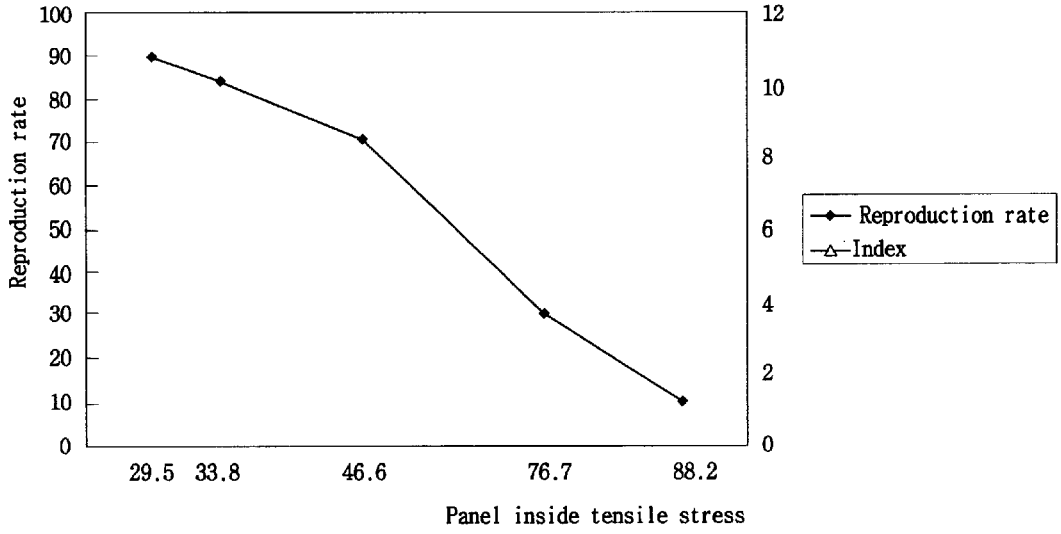
Figure 11:
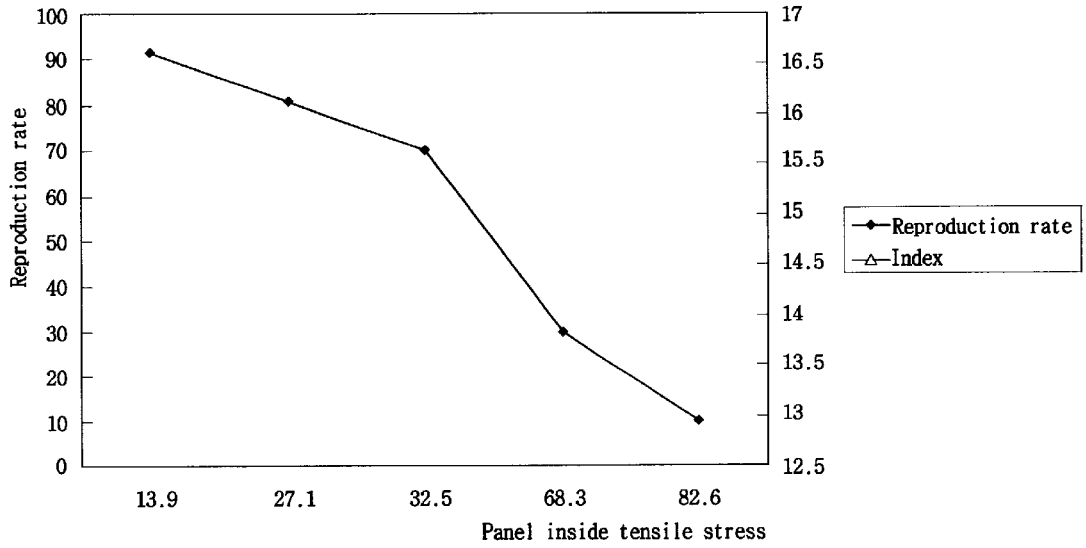

In case of 25" FCD (590 mm), the salvage rate is 70% approximately when the panel inside tensile stress (P_in) of the fused portion of the panel and funnel is 46.6 (Kgf/cm$^2$) and it abruptly decreases when the tensile stress exceeds 46.6 (Kgf/cm$^2$) as shown in Table 7 and FIG. 10. In case of 29" FCD (676 mm), the salvage rate is 70% approximately when the panel inside tensile stress (P_in) is 32.5 (Kgf/cm$^2$) and it abruptly decreases when the tensile stress is larger than 32.5 (Kgf/cm$^2$) as shown in Table 8 and FIG. 11.

Figure 12:
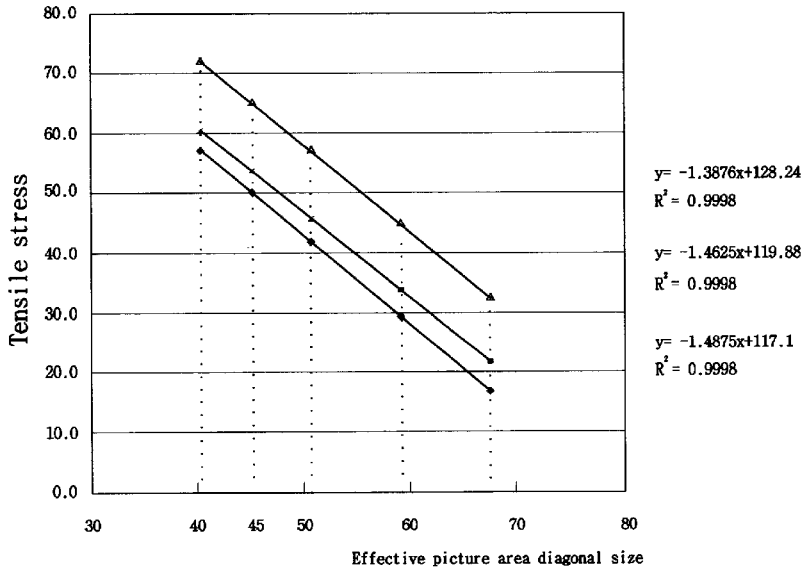
FIG. 12 is a graph showing a relationship between the size of the effective screen of the cathode-ray tube and the panel inside tensile stress (P_in) that affects the salvage rate.

FIG. 12 is a graph showing a relationship between the size of the effective picture area of the cathode-ray tube and the panel inside tensile stress (P_in) that affects the salvage rate. This graph illustrates that the size of the effective picture area and the panel inside tensile stress (P_in) have a mutual linear relation. Specifically, when the size of the effective picture area of the cathode-ray tube is x and the panel inside tensile stress is y, $y=-1.3876x+128.24$ in case of the salvage rate of 70%, $y=-1.4625x+119.88$ in case of the salvage rate of 85% and $y=-1.4875x+117.1$ in case of the salvage rate of 90%. These expressions have similar slopes. Accordingly, in case where the size of the effective picture area of the cathode-ray tube is x (unit: cm), the salvage rate of the cathode-ray tube can be increased when the panel inside tensile stress (P_in) is kept below $-1.3876x+128.24$. Further, it is preferable when the tensile stress is kept below $-1.4625x+119.88$, and more preferable when it is maintained below $-1.4875x+117.1$.

To manage the panel inside tensile stress (P_in) at the fused portion of the panel and funnel according to the present invention, the index time in the sealing furnace should be managed substantially as described above. In this case, the panel inside tensile stress (P_in) becomes smaller as the index time becomes longer and the critical tensile stress of the material of the fused portion is also decreased. However, it is not preferable to lengthen the index time in order to lower the tensile stress in case of the salvage rate of 90–100% in terms of yield. Accordingly, it is preferable that the minimum tensile stress of the fused portion of the panel and funnel is 56.9±5 (Kgf/cm$^2$) in case of 17" FCD cathode-ray tube, 49.3±3 (Kgf/cm$^2$) in case of 19" FCD, 36.7±2 (Kgf/cm$^2$) in case of 21" FCD, 29.5±3 (Kgf/cm$^2$) in case of 25" FCD, and 13.9±1 (Kgf/cm$^2$) in case of 29" FCD. Here, the error range of 5–10% approximately was given because the optimal panel inside tensile stress (P_in) at the fused portion of the panel and funnel was obtained when the salvage rate is 90–95%.

According to the present invention, as described above, the panel inside tensile stress at the fused portion of the panel and funnel is maintained below a predetermined value to mitigate breakage inside the furnaces that occurs when the cathode-ray tube having the panel whose outside is near flat and whose inside has a predetermined curvature is reproduced, thereby improving the salvage rate.

Although specific embodiments including the preferred embodiment have been illustrated and described, it will be obvious to those skilled in the art that various modifications may be made without departing from the spirit and scope of the present invention, which is intended to be limited solely by the appended claims.

What is claimed is:

1. A cathode-ray tube including an envelope having a neck, a funnel and a panel fused to the funnel by using frit glass, the outside of the panel being near flat, the inside of the panel having a predetermined curvature, wherein $1.7 \leqq T2/T1 \leqq 2.3$ when T1 is the thickness of the center of the panel and T2 is the thickness of the diagonal corner of the panel, and a panel inside tensile stress at the fused portion of the panel and funnel is less than $-1.3876x+128.24$ (Kgf/cm$^2$) when the size of the effective picture area of the cathode-ray tube is x (unit: cm).

2. The cathode-ray tube as claimed in claim 1, wherein the panel inside tensile stress at the fused portion of the panel and funnel is less than $-1.4625x+119.88$ (Kgf/cm$^2$) when the size of the effective picture area of the cathode-ray tube is x (unit: cm).

3. The cathode-ray tube as claimed in claim 1, wherein the panel inside tensile stress at the fused portion of the panel and funnel is less than $-1.4875x+117.1$ (Kgf/cm$^2$) when the size of the effective picture area of the cathode-ray tube is x (unit:cm).

4. A cathode-ray tube including an envelope having a neck, a funnel and a panel fused to the funnel by using frit glass, the outside of the panel being near flat, the inside of the panel having a predetermined curvature, wherein $1.7 \leqq T2/T1 \leqq 2.3$ when T1 is the thickness of the center of the panel and T2 is the thickness of the diagonal corner of the panel, and a panel inside tensile stress P_in at the fused portion of the panel and funnel satisfies $13.9 \pm 1$ (Kgf/cm$^2$)$\leqq$P_n$\leqq$72.0 (Kgf/cm$^2$).

5. The cathode-ray tube as claimed in claim 4, wherein the diagonal length of the effective picture area of the panel is less than 40.6 cm, and the panel inside tensile stress P_in at the fused portion of the panel and funnel satisfies $56.9 \pm 5$ (Kgf/cm$^2$)$\leqq$P_in$\leqq$72.0 (Kgf/cm$^2$).

6. The cathode-ray tube as claimed in claim 5, wherein the panel inside tensile stress P_in at the fused portion of the panel and funnel satisfies $56.9 \pm 5$ (Kgf/cm$^2$)$\leqq$P_in$\leqq$60.4 (Kgf/cm$^2$).

7. The cathode-ray tube as claimed in claim 4, wherein the diagonal length of the effective picture area of the panel is larger than 40.6 cm but less than 45.7 cm, and the panel inside tensile stress P_in at the fused portion of the panel and funnel satisfies $49.3 \pm 5$ (Kgf/cm$^2$)$\leqq$P_in$\leqq$63.7 (Kgf/cm$^2$).

8. The cathode-ray tube as claimed in claim 7, wherein the panel inside tensile stress P_in at the fused portion of the panel and funnel satisfies $49.3 \pm 5$ (Kgf/cm$^2$)$\leqq$P_in$\leqq$53.1 (Kgf/cm$^2$).

9. The cathode-ray tube as claimed in claim 4, wherein the diagonal length of the effective picture area of the panel is larger than 45.7 cm but less than 50.8 cm, and the panel inside tensile stress P_in at the fused portion of the panel and funnel satisfies $36.7 \pm 2$ (Kgf/cm$^2$)$\leqq$P_in$\leqq$57.1 (Kgf/cm$^2$).

10. The cathode-ray tube as claimed in claim 9, wherein the panel inside tensile stress P_in at the fused portion of the panel and funnel satisfies $36.7 \pm 2$ (Kgf/cm$^2$)$\leqq$P_in$\leqq$56.9 (Kgf/cm$^2$).

11. The cathode-ray tube as claimed in claim 4, wherein the diagonal length of the effective picture area of the panel is larger than 50.8 cm but less than 67.6 cm, and the panel inside tensile stress P_in at the fused portion of the panel and funnel satisfies $29.5 \pm 3$ (Kgf/cm$^2$)$\leqq$P_in$\leqq$46.6 (Kgf/cm$^2$).

12. The cathode-ray tube as claimed in claim 11, wherein the panel inside tensile stress P_in at the fused portion of the panel and funnel satisfies $29.5 \pm 3$ (Kgf/cm$^2$)$\leqq$P_in$\leqq$33.8 (Kgf/cm$^2$).

13. The cathode-ray tube as claimed in claim 4, wherein the diagonal length of the effective picture area of the panel is larger than 67.6 cm, and the panel inside tensile stress P_in at the fused portion of the panel and funnel satisfies $13.9 \pm 1$ (Kgf/cm$^2$)$\leqq$P$_{\leqq in \leqq}$32.5 (Kgf/cm$^2$).

14. The cathode-ray tube as claimed in claim 13, wherein the panel inside tensile stress P_in at the fused portion of the panel and funnel satisfies $13.9 \pm 1$ (Kgf/cm$^2$)$\leqq$P_in$\leqq$27.1 (Kgf/cm$^2$).

* * * * *